United States Patent [19]

Bozinovic

[11] Patent Number: 4,984,795

[45] Date of Patent: Jan. 15, 1991

[54] SURFACE PROJECTILE GAME WITH ZIG-ZAG BALL

[76] Inventor: Zoran Božinović, Bulevar JNA 105, 11000 Belgrade, Yugoslavia

[21] Appl. No.: 311,614

[22] Filed: Feb. 15, 1989

[30] Foreign Application Priority Data

Feb. 17, 1988 [YU] Yugoslavia ..... 309/88

[51] Int. Cl.[5] ..... A63F 3/00

[52] U.S. Cl. ..... 273/126 R; 273/128 A

[58] Field of Search ..... 273/126 R, 128 A, 126 A, 273/58 F, 58 G

[56] References Cited

U.S. PATENT DOCUMENTS

| | | | |
|---|---|---|---|
| 1,364,632 | 1/1921 | Harrington | 273/110 |
| 2,563,340 | 8/1951 | Hotte | 273/110 |
| 2,665,912 | 1/1954 | Juran | 273/58 F |
| 3,554,553 | 1/1971 | Hayashi | 273/128 A |
| 4,194,737 | 3/1980 | Farmer | 273/128 A |

FOREIGN PATENT DOCUMENTS

| | | | |
|---|---|---|---|
| 782817 | 11/1980 | U.S.S.R. | 273/58 R |
| 224710 | 11/1924 | United Kingdom | 273/126 R |

*Primary Examiner*—Theatrice Brown

*Attorney, Agent, or Firm*—Faegre & Benson

[57] ABSTRACT

A sports game with zig-zag ball, intended for fun and recreation. The required playing surface for this game is a flat surface about 1.5 m wide and about 20 m long, on which central line 10 and at least one pin 2 or gate 7 is placed between two fields 9. This pin 2 is crossed around when the ball 3 crosses the central line 10 behind that pin and in front of the next pin 2', and the winner of the game is the player who has the largest number of crossed pins 2 from a certain number of trials. A zig-zag ball useful as a toy or in sports is disclosed. The ball moves in a zig-zag manner when rolled out on a flat horizontal surface. The zig-zag movement is achieved by a mechanism placed inside the ball which alters the center of gravity of the ball as it rolls. In one embodiment of the invention the ball contains an internal shaft with engraved left and right threads, a hollow cylinder slidably mounted on the shaft, a weight attached to the cylinder and a pin on the cylinder contacting and following the threads as the ball rolls and the cylinder turns on the shaft.

3 Claims, 4 Drawing Sheets

SURFACE PROJECTILE GAME WITH ZIG-ZAG BALL

Figure 1:
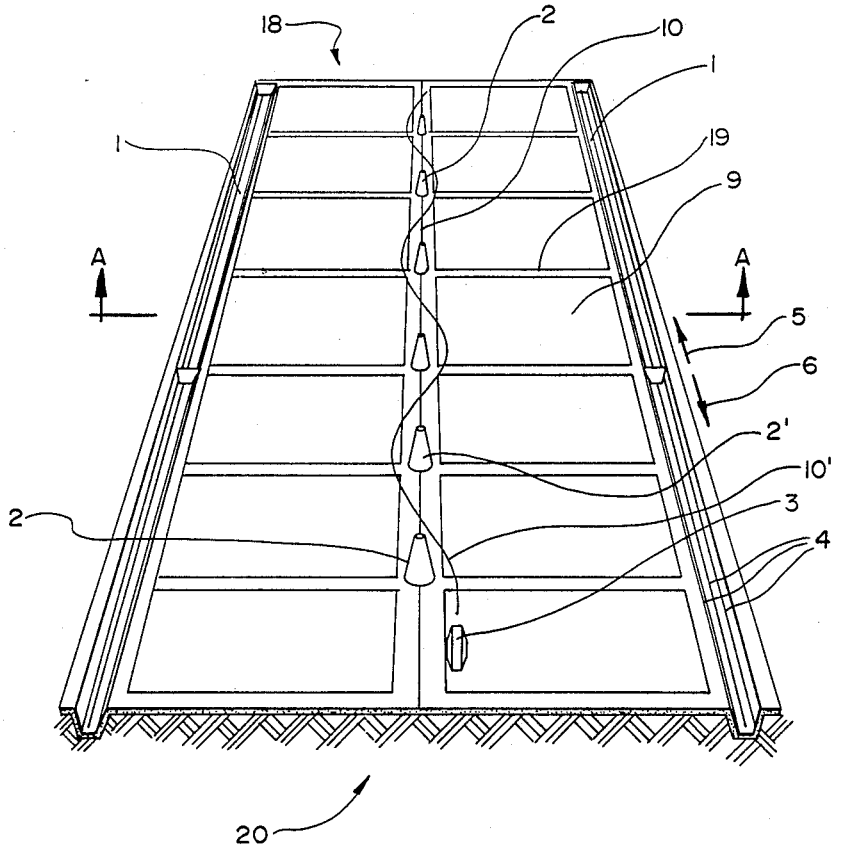

This invention relates to a sports game with a zig-zag ball in the field of sports and amusing games which can be played (indoors and outdoors).

The technical problem which is solved by this invention is a sports game or a game for amusement or recreation using a zig-zag ball which rolls on a certain sinusoidal path on a flat surface, intending the ball to go around as many bowling pins as possible.

The zig-zag ball is disclosed in the specification of U.S. Pat. No. 4,609,196 corresponding to Yugoslavian P-1633/87 by the same inventor. The zig-zag ball rolls on a sinusoidal path, which path depends on the mass of weight placed inside the ball. In ideal conditions the ball always has the same amplitude and period of oscillation, when given a certain starting speed. Because ideal conditions are impossible to construct in practice, the oscillation and period are different from one throw to another. The difference is smaller if the surface on which the ball rolls is flatter.

The technical problem is solved by this invention in the following manner: A plurality of pins 2, 2' are positioned on a central line 10 of a sinusoidal path 10', between two fields 9. Three shafts 4 for returning a ball 3 are positioned on the lateral sides of the path 10', in the channels 1 extending in the direction of the arrows 5, 6 from the mid point. The ball 3 is pushed on the path 10' to go around pins 2, 2' from one side or the other of the front 20 of playing surface 17.

The ball 3 crosses the central line 10 around behind pin 2 and in front of the next pin 2'. The winner of the game is the player which has the largest number of crossings around the pins 2, 2'.

In another variant of the invention, (shown in FIG. 3) gates 7 are placed on the central line 10 in close order instead of the pins 2, 2.

In another aspect of the invention, two strip transporters 8 are built in the channels 1 for returning the ball 3 to the players by transporting the ball 3 towards one or the other front side 20 of path 10'.

The invention is shown in a detailed description of an example shown in the drawings wherein:

FIG. 1 shows an isometric view of the path 10' with a lateral channel 1 and with bowling pins 2, 2' on the central line 10.

Figure 2:
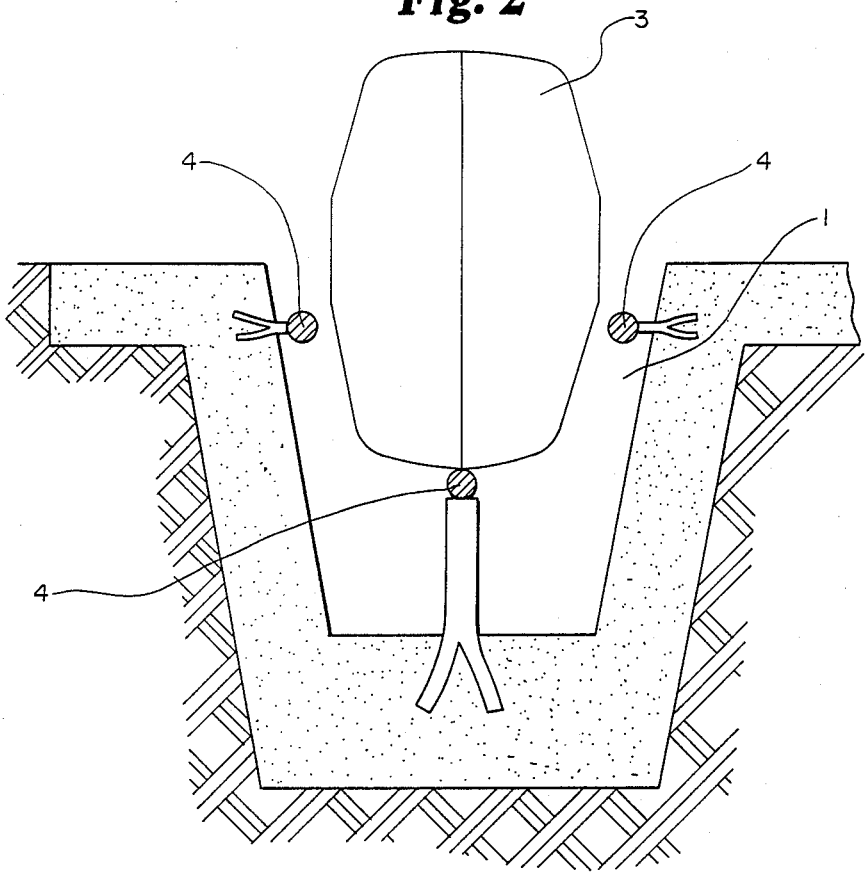

FIG. 2 shows (in enlarged proportion) cross section A—A of the channel 1 from FIG. 1 in which the ball 3 is resting on shafts 4 and which rolls in direction to the player.

Figure 3:
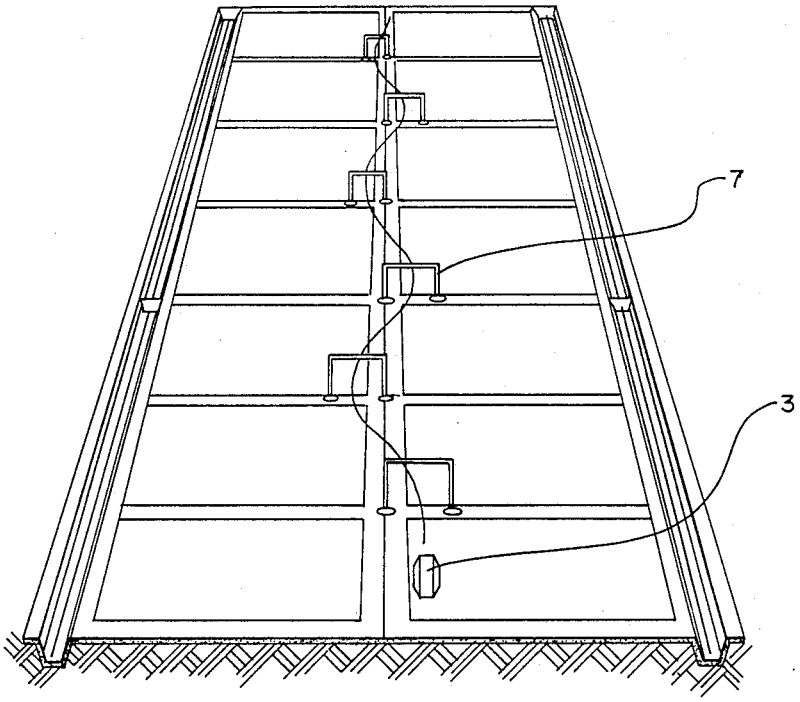

FIG. 3 shows an isometric view of the path 10' with lateral channels 1, as in the FIG. 1, but with the gates 7 in place of pins 2, 2.

Figure 4:
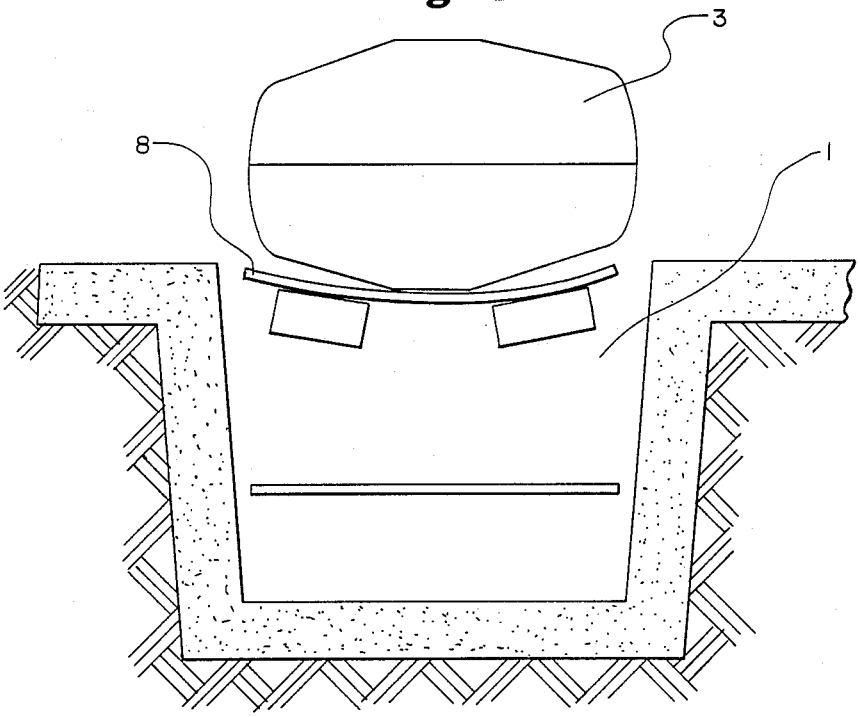

FIG. 4 shows a variant of the channel 1 in cross section, where two strip transporters 8 are placed, which come face to face at the mid-point of path 10' and turn in the opposite directions.

Figure 5:
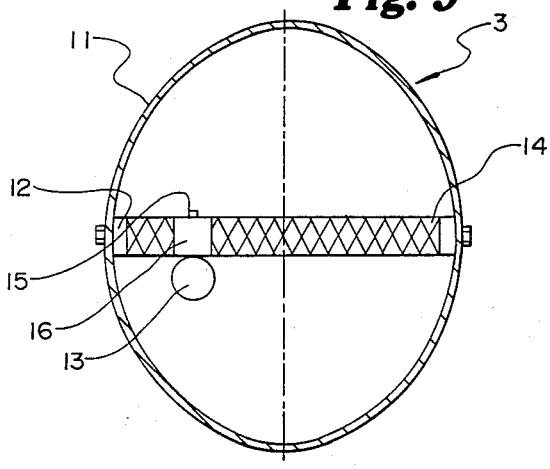

FIG. 5 is a vertical radial section view of a preferred embodiment of the ball of the present invention.

In FIG. 1, a playing surface 17 for the sports game with zig-zag ball is shown which is at least 1.5 m wide and about 20 m long. The playing surface 17 is a flat concrete surface, polished until it becomes a black concrete colour. The central line 10 is white coloured. Every 3 m the same or different coloured horizontal lines 19 are drawn, perpendicular in direction to channel 1, making fields 9.

Referring now to FIG. 2, the channels 1 placed laterally on both sides of the playing surface 17 are preferably made of concrete of a certain depth. From the mid point of the path 10' shafts 4 are secured and have an inclination in the direction of arrow 5 in one-half and in the direction of the arrow 6 in the other half. This means that ball 3 which is turned from the path 10' and rolled in the channel 1 before the mid point of the path 10' will be returned in the direction of arrow 6 (FIG. 1) toward the player who threw the ball 3, in other words to the player who gave the ball 3 its starting speed, because the shafts 4 in the channel 1 are inclined to the front or starting part 20 of the path 10'. If the ball 3 comes into channel 1 in the second half of the path 10', then the ball 3 will, because of the inclination of the direction of the other end of the channel 1, roll in direction of the other end or rear 18 of the path 10', more exactly to the other player on the other end 18 of the path 10'.

FIG. 3 shows a path with lateral channels 1 which is the same as in the FIG. 1, but instead of pins 2, 2' on the central line 10, one leg of a plurality of gates 7 are placed in close order.

FIG. 4 shows a variant of channel 1 in which one strip transporter 8 is placed along one half length of the path 10', and which turns in one direction; in the other half length of the path 10' there is a second strip transporter 8 which turns in the other direction. This variant is more expensive, because it requires a particular electric motor for each transporter 8 (totalling four), and all that increases the consumption of energy.

The sports game is played the following way:

Referring to FIGS. 1 or 3, one or two players with the ball 3 occupy the front side 20 of playing surface 17. The aim of the game is to roll ball 3 sinusoidally on the path 10' to pass around the certain number of pins 2,2' at least once. The ball 3 can turn from the path 10' and go into the channel 1 and by rolling (or by transporter 8) come to the starting line or front 20 of the path 10'.

When one player gives a certain speed to ball 3 by throwing it tangentially on the path 10' pin 2 is passed and the ball 3 crosses the part of line 10 behind that pin 2 and in front of the next pin 2' or in the case of the end of the path, crossing the last pin 2 in the row on the path 10'.

The winner of the game is that player who, after a certain number of trials, has the largest number of points, meaning that he has the largest number of crossed pins.

This invention further relates to a special kind of ball which moves in a zig-zag manner when rolled out on a flat horizontal surface. Such a ball is a toy or a sports requisite. As far is known, a ball with similar characteristics has never been invented and/or made. The object of this invention is to provide a ball suitable for an "anti-bowling" game, i.e. a game in which the aim is to roll the ball out in a bowling manner, with the intention to avoid obstacles distributed on a flat surface in front of the player.

The main characteristic of the zig-zag ball according to the invention is that the ball, rolling freely on a flat horizontal surface, travels along a sinusoidal path. This kind of movement is achieved by a mechanism placed inside the ball which causes the center of gravity of the ball to reciprocate in a repeating pattern as the ball rolls. One mechanism for achieving this result consists of a shaft with left and right threads traversing the hollow interior of the ball, a weight slidably supported on the shaft and a pin attached to the weight support which contacts the threads.

The same movement can be achieved by a mechanism consisting of a hollow endless spiral tube with a heavy metal ball running through it or by a mechanism consisting of a system of balanced levers.

Additional features of the invention will be evident from the following description of a preferred embodiment of the ball, given by way of example only, and by reference to the appended drawing FIG. 5.

Referring to FIG. 5, the zig-zag ball 3 according to the invention consists of a body 11, in which there is a shaft 12 with a left and right thread 14. A hollow cylinder 16 with a weight 13 and a pin 15 is slipped on the shaft 12. The pin 15 is in contact with the threads 14 engraved in the shaft 12.

While the ball 3 is rolling, the body 11 and the shaft 12 are rotating, but the weight 13 does not permit rotation of the cylinder 16 slipped on the shaft 12. In that way, the weight 13, with the cylinder 16 and the pin 15, is forced to move axially along the shaft 12, from one side to another. When the pin 15 comes to the end of the right thread, it continues following the left thread (and vice-versa), which means that the weight 13, the cylinder 16 and the pin 15 start moving to the other side of the ball 3. The consequence of that axial movement is an oscillation of the center of gravity of the whole device, from one side to another. That reciprocating oscillation forces the rolling ball 3 to enter left or right turns, which results in a zig-zag movement of the ball 3.

I claim:

1. A surface projectile game apparatus comprising a game board having a substantially flat playing surface of about 1.5 m in width and about 20 m in length, said playing surface having a longitudinal center line and a plurality of spaced apart lines extending transversely across said playing surface and intersecting said center lines to define a plurality of discrete areas on said playing surface, a plurality of barriers, each said barrier being placed along said center line at a said intersection, means defining a channel along opposite longitudinal sides of said playing surface, each said channel having three spaced apart shafts placed therein, said shafts sloping downwards from the longitudinal mid-point of said game board to opposite ends thereof, two of said shafts lying in an inclined plane and the third shaft being below and intermediate said two shafts, a ball, said ball having means therein for causing said ball to roll along a substantially sinusoidal path when rolled over said playing surface whereby when said ball is rolled along said center line will alternately pass between a pair of said barriers as it progresses from one end towards the other end of said playing surface, said ball when improperly pushed by a player will fall into a said channel, rest upon said shafts and return to one end of said game board.

2. A surface projectile game apparatus as defined in claim 1 wherever said barriers are in the form of bowling pins.

3. A surface projectile game apparatus as defined in claim 1 wherever said barriers are inverted U-shaped gates, each of said gates having a pair of spaced apart vertical legs and a horizontal member extending between and attached to the upper end of said legs, said inverted U-shaped gate being placed at a said intersection and along said center line in alternate fashion relative to said center line such that a leg of one gate is placed at a said intersection and the other leg of said gate is placed on one side of said center line and a leg of a following gate is placed at a next intersection and the other leg of said following gate is placed on the side of said center line opposite said one side, said ball passing through said gates as it moves along said path.

* * * * *